United States Patent [19]

Hedstrom et al.

[11] 4,285,555

[45] Aug. 25, 1981

[54] DOCUMENT HOLDER

[75] Inventors: Norman A. Hedstrom; Robert G. Bogren, both of Worcester; David M. Wright, Shrewsbury, all of Mass.

[73] Assignee: Wright Line Inc., Worcester, Mass.

[21] Appl. No.: 102,150

[22] Filed: Dec. 10, 1979

[51] Int. Cl.[3] ..... A47B 65/00; B42F 3/00

[52] U.S. Cl. ..... 312/184; 312/188; 312/190; 402/4

[58] Field of Search ..... 312/184, 183, 185, 186, 312/187, 188, 190, 233; 402/4, 17, 38; 211/42, 43

[56] References Cited

U.S. PATENT DOCUMENTS

| | | | |
|---|---|---|---|
| 2,218,105 | 10/1940 | Griffin | 402/38 |
| 2,439,675 | 4/1948 | Segal | 402/38 |
| 2,494,382 | 1/1950 | Faulkner et al. | 211/43 |
| 2,794,697 | 6/1957 | Bergman | 312/233 |
| 3,132,649 | 5/1964 | Gits | 402/38 |
| 3,801,175 | 4/1974 | Giulie | 312/184 |
| 3,980,360 | 9/1976 | Wright et al. | 312/184 |
| 4,056,296 | 11/1977 | Hedstrom et al. | 312/184 |
| 4,070,073 | 1/1978 | Schudy et al. | 312/184 |
| 4,133,590 | 1/1979 | Young | 312/184 |
| 4,171,854 | 10/1979 | Hedstrom et al. | 312/184 |

FOREIGN PATENT DOCUMENTS

| | | | |
|---|---|---|---|
| 2462311 | 12/1974 | Fed. Rep. of Germany | 402/4 |

*Primary Examiner*—Victor N. Sakran
*Attorney, Agent, or Firm*—Milton E. Gilbert

[57] ABSTRACT

A document holder has a rigid spine piece dimensioned to accommodate the spine of the binding of the document to be filed and a plurality of fingers at both head and tail ends dimensioned and movably disposed to engage the head and tail of the spine between themselves and the spine piece.

11 Claims, 6 Drawing Figures

DOCUMENT HOLDER

This invention relates to document holders, and more particularly to devices provided with an eccentrically located pivotal suspension for both suspension filing and display of permanently- or temporarily-bound materials.

BACKGROUND OF THE INVENTION

Document holders designed for use in suspension filing and display systems are well known. A commonly encountered device of this type utilizes an eccentrically located pivotal suspension to rotatably support, in a filing system of the type comprising a single supporting hanger, bound documents in either a closed, spine-up filed position or an open, spine-down displayed position. Among such holders are those designed to accommodate bound or sectioned materials, such as periodicals, catalogues, directories and the like, typically by holding such materials captive to the holder by one or more wires or bands attached to the holder, inserted in the fold between adjacent leaves, and extending from the head to the tail of the material. Such holders are shown in connection with filing and display systems in U.S. Pat. Nos. 2,494,382 and 2,794,697. Also well known are document holders designed for use with similar filing and display systems which incorporate posts designed to hold captively assembled to the holders looseleaf documents, such as computer printouts, at least one margin of which has been provided with a plurality of appropriate apertures. Such document holders are exemplified in U.S. Pat. Nos. 3,980,360 and 4,056,296.

In the case of the first of these types of document holders, the installation and removal of documents is often cumbersome. While not necessarily a disadvantage (indeed, in such applications as the public storage and display of documents it becomes an advantage) this aspect of these devices is not always desirable. Further, it should be noted that in the case of documents which are bound only in individual sections, such as magazines and brochures, the number of individual terms which can be accommodated in a single holder is severely limited by the number of bands. The second type of document holder, while not as severely limiting the number of items which can be accommodated in a single holder, suffers in some applications in that intercalation of items is cumbersome.

OBJECTS OF THE INVENTION

Accordingly, a primary object of the present invention is to provide a document holder of the type utilizing an eccentrically located pivotal suspension to rotatably support it in a suspension filing system of the type comprising a single support hanger which can accommodate both permanently bound and looseleaf materials.

Another object is to provide a document holder which may be readily attached to and releasd from bound documents.

Yet a further object is to provide such a document holder which is particularly suited to the accommodation of ring binders.

SUMMARY OF THE INVENTION

These and other objects are met in the present invention of a document holder in which a rigid spine piece, dimensioned to accommodate the spine of the binding of the document to be filed and displayed, is provided with a plurality of fingers at both head and tail ends, the fingers being so dimensioned and disposed as to engage the head and tail of the spine of the document between themselves and the spine piece. Installation and removal of documents in and from the spine piece is facilitated by provision for displacing the fingers at one end of the spine piece away from and toward the fingers at the other end. The fingers are normally restrained in the position in which they engage the spine of the document by a defeatable restraining device, such as a spring. The spine piece is provided with an eccentrically located hook for mounting the holder to a filing system of the type comprising a single supporting hanger. Document holders made in accordance with the principals of the present invention may be readily dimensioned to accommodate standard ring-type looseleaf binders, thereby providing means for the ready intercalation of items in a document storage and display system.

Other features and many of the advantages of the invention are set forth in or rendered obvious by the following detailed description in consideration of the accompanying drawings.

BRIEF DESCRIPTION OF THE DRAWINGS

In several views, like numbers are used to designate like parts so as to facilitate a concise description of the invention.

DETAILED DESCRIPTION

Figure 1:
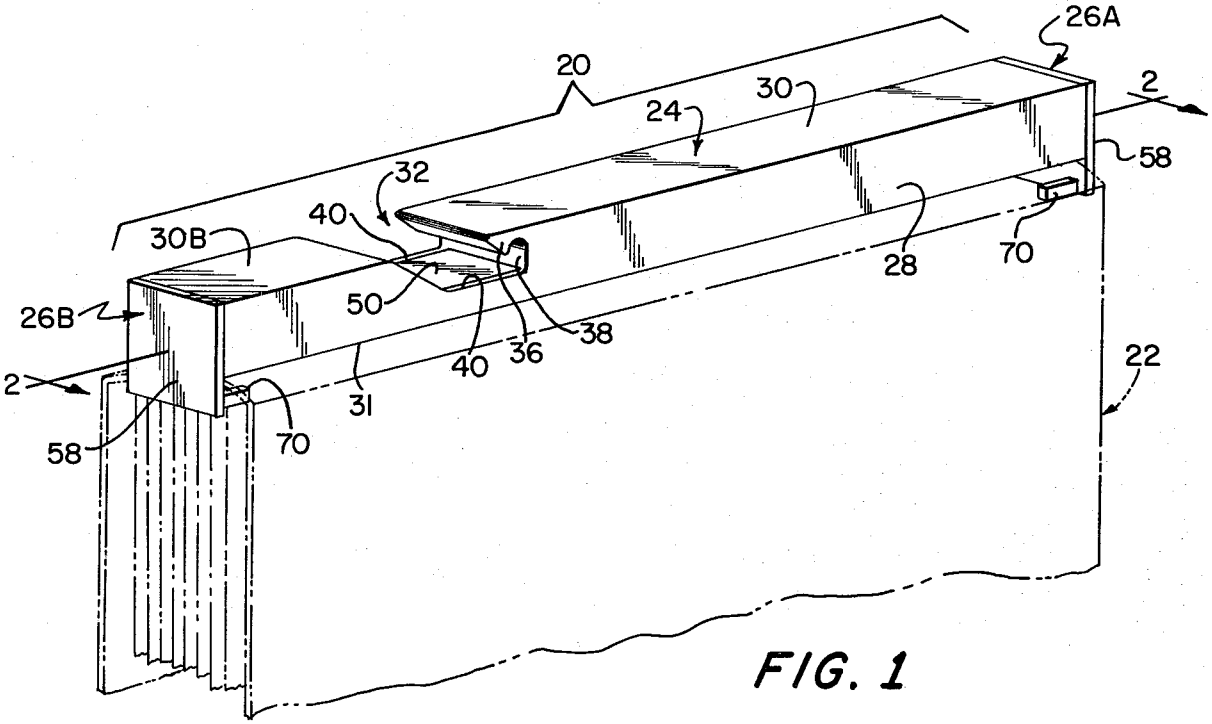
FIG. 1 is a perspective view of a document holder constituting a preferred embodiment of the invention carrying a notebook indicated in dashed lines.

Referring now in greater detail to the drawings, there is shown in FIG. 1 a hanging type document holder 20 designed to accommodate permanently or temporarily bound materials, typified by a conventional looseleaf binder 22 shown in phantom, and to secure such materials detachably to a suspension filing system of the type having a single center suspension rail. Holder 20 comprises an elongate spine 24 and head and tail end pieces 26A and 26B respectively. Spine 24 and end pieces 26A and 26B may be fabricated out of any substantially rigid yet resiliently distortable material. By way of example but not limitation, the spine and end pieces may be molded of a synthetic polymer such as medium or high density polyethylene, polystyrene, or the like.

Figure 5:
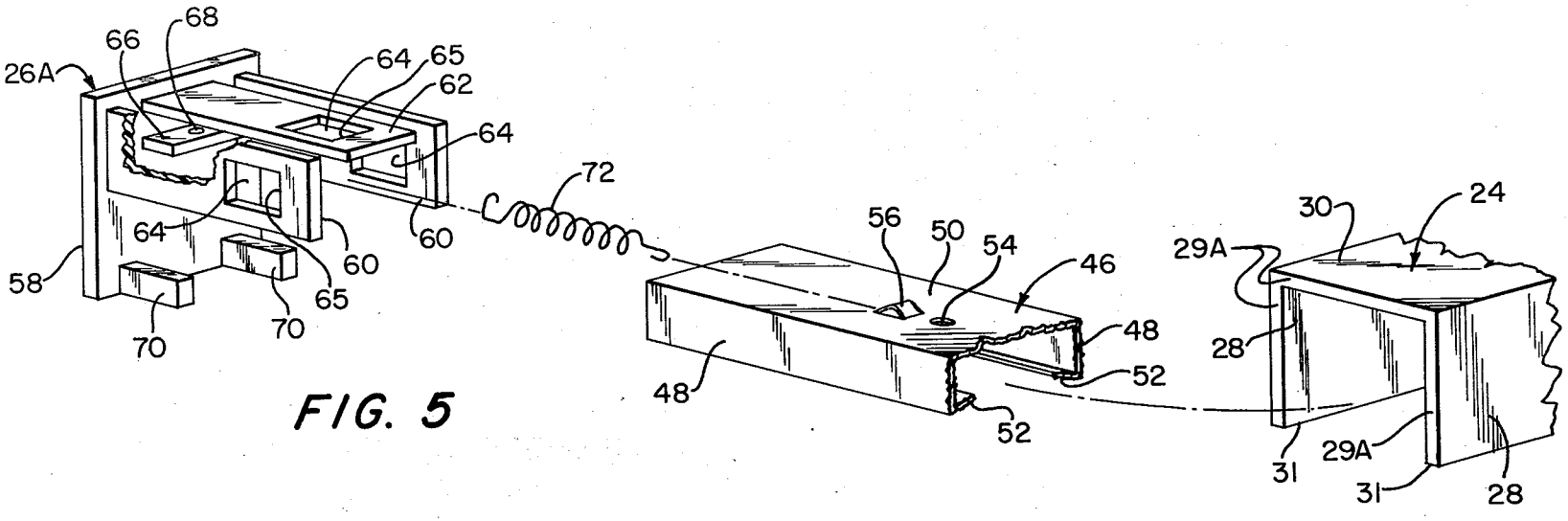
FIG. 5 is a fragmentary exploded perspective view, cut away in part, of significant portions of the head end of the document holder of FIG. 1.

Spine 24 is of open ended channel form, as may be seen by reference to FIG. 5. More particularly, spine 24 comprises a pair of mutually parallel relatively thin-walled planar sides 28 attached normal to the included relatively thin-walled planar back 30. In general outline, sides 28 and back 30 are each substantially rectangular, each long edge of the rectangle bounding back 30 being common with a long edge of a rectangle bounding the corresponding side 28. One set of corresponding short edges of each side 28 and back 30 terminates in a substantially planar lip 29A, the other set, in a similar lip 29B, the suffixed letters being added only for clarity in the description which follows hereinafter, and denoting, respectively, the head and tail of spine 24 (i.e., the ends of spine 24 designed to accommodate respectively the head and tail of the spine of binder 22). The long edges of each side 28 distal from back 30 are finished off in lips 31, which are substantially coplanar and equidistant from the plane of back 30. The length of spine 24, as measured from lip 29A to lip 29B, is chosen to be slightly less than the height of the particular binder 22 to be accommodated, while the width of the spine, from side to side, is chosen to be on the order of the width of the binder. The height of sides 28, as measured from back 30 to edges 31, is chosen to accommodate the structure described hereinafter, while the thicknesses of the walls constituting sides 28 and back 30 are chosen on the basis of the strength of the material from which they are fabricated.

Figure 3:
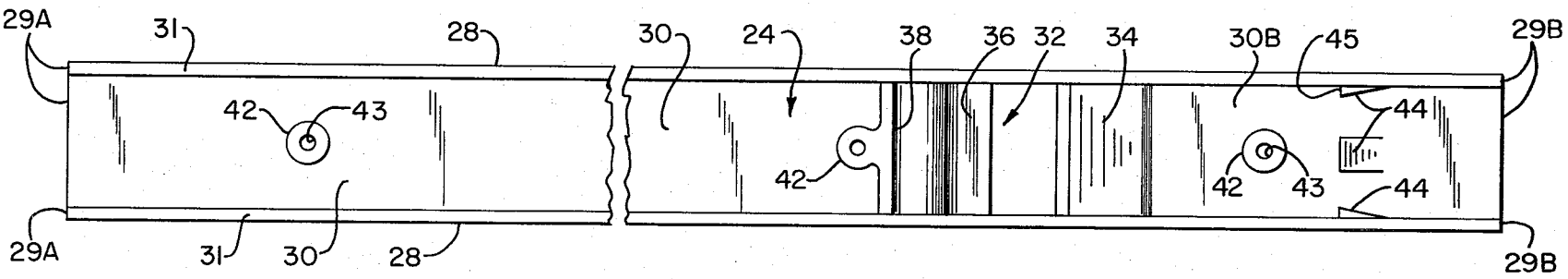
FIG. 3 is a bottom plan view of the interior of the spine portion of the document holder of FIG. 1.

A hook, identified generally by numeral 32, interrupts the back and sides of spine 24. Hook 32 comprises inclined wall section 34, hooked tab 36, and wall section 38, which may best be seen in plan and section in FIGS. 3 and 2, respectively. Inclined wall section 34 and wall section 38 extend between and at substantially right angles to sides 28. Inclined wall section 34 extends at an angle, preferably 45° as shown, to the plane of back 30, joining back 30 along a line displaced toward tail lip 29B from the center of the back, and extending toward lips 31 of sides 28 the further inclined wall section 34 becomes from lip 29B. Opposite inclined wall section 34 back 30 is interrupted by hooked tab 36, recessed beneath which (i.e., in the direction of lips 29A and 31 from the hooked tab) is wall section 38. Wall section 38 joins back 30 at tab 36 and is disposed substantially normal to the back. In a preferred embodiment, wall section 38 is displaced toward tail lip 29B from the center of the back, although it will be understood it may be located so as to center hooked tab 36, if desired. Both inclined wall section 34 and wall section 38 extend substantially equal distances toward lips 31 from the plane of back 30. Between inclined wall section 34 and wall section 38 sides 28 to not extend from edges 31 entirely to back 30, but terminate, at their closest approach to the back, at edges 40, as may be seen in FIG. 1. Edges 40 are substantially coplanar and parallel to the plane of back 30, and are situated at substantially the same distance from the back as are the extremities distal from back 30 of inclined wall section 34 and wall section 38. It will be understood that the disposition of inclined wall section 34, hooked tab 36, wall section 38, and edges 40 relative to one another must be such as to accommodate the supporting structure of the filing system with which spine 24 is to be used.

Referring again to FIGS. 2 and 3, there may be seen a number of posts 42 affixed to the interior of spine 24 along the longitudinal axis of back 30. The posts 42 nearest lips 29A and 29B are so located as to provide clearance for end pieces 26A and 26B, as will be described hereinafter. Posts 42 are preferably of cylindrical form, and extend normal to the plane of the back toward the plane of lips 31 by substantially the same distance as do wall sections 34 and 38. In a preferred embodiment, one of the posts is incorporated, by appropriate fairing, into the adjacent wall section 38. Each post 42 is provided with an axial tapped hole 43.

Also affixed to the interior of spine 24 are a plurality of ratchet-shaped latch means comprised of inclined faces 44 and latch faces 45. Inclined faces 44 and latch faces 45 are disposed on both back 30 and sides 28 between tail lip 29B and the post 42 nearest the lip, with the inclined faces nearer the lip than are the latch faces. Inclined faces 44 are substantially planar, and rectangular in plan. Inclined faces 44 make slight angles (i.e., on the order of 10°) with their respective side 28 or back 30. The lines of intersection of inclined faces 44 and the respective side or back is substantially parallel to the plane of tail lip 29B. From these lines of intersection, inclined faces 44 increase in distance from their respective back or side as they increase in distance from lip 29B. Distal from lips 29B inclined faces 44 are all terminated by intersection with respective latch faces 45. Latch faces 45 are all substantially coplanar and parallel to the plane of tail lip 29B; they are disposed at a distance from the tail lip so as to provide adequate clearance between themselves and the post 42 nearest to allow operation of the latching means on tail end piece 26B as will be described hereinafter. Inclined faces 44 are so arranged that the maximum distance each achieves from its respective side 28 or back 30 is on the order of the thickness of a side 28. The transverse dimensions of the inclined faces 44 on sides 28 are each chosen to be less than the length of a post 42 (i.e. the extent of a post 42 normal to back 30) by an increment equal to at least twice the thickness of a side; these inclined faces are disposed on the sides a distance from back 30 amounting to half this increment. The transverse dimension of the inclined face 44 disposed on the interior of back 30 is chosen to be less than the separation between sides 28 by at least an amount equal to six times the thickness of a side; this inclined face is located substantially along the longitudinal axis of the back.

Figure 2:
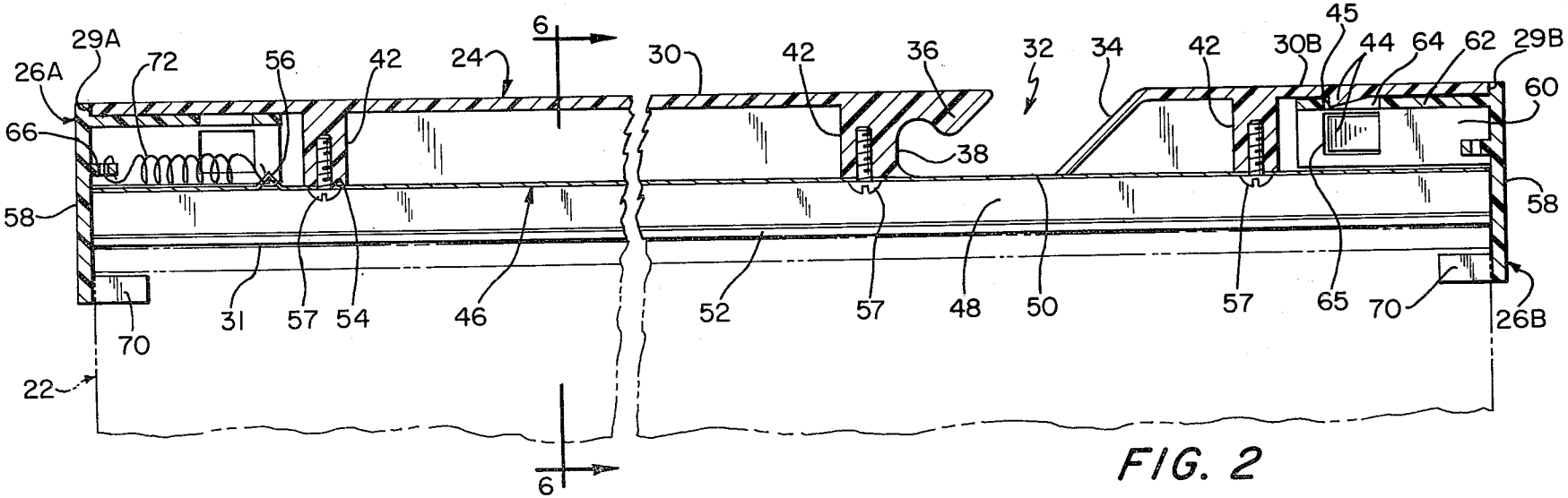
FIG. 2 is a longitudinal sectional view of the document holder of FIG. 1 taken along the line 2—2 of FIG. 1.

Spine 24 is provided with a reinforcing piece 46, which may be seen in section and in perspective (in part) in FIGS. 2 and 5, respectively. Reinforcing piece 46 is in the form of an open-ended channel with parallel sides 48 normal to an included back 50. The edges of sides 48 distal from back 50 are finished in a pair of reentrant lips 52. Reinforcing piece 46 is so dimensioned as to fit snugly into the channel between sides 28 of spine 24, with back 50 resting on posts 42 and wall sections 34 and 38 and with sides 48 in contact with opposing sides 28. Sides 48 are dimensioned to extend from back 50 a distance substantially equal to the distance lips 31 of sides 28 are from back 30, less the length of a post 42. The length of reinforcing piece 46 is chosen to be substantially equal to that of spine 24. Reentrant lips 52 are so angled with regard to sides 48 as to substantially conform to the convexity of the spine of the book or binder 22 to be accommodated by holder 20. Back 50 is provided with a plurality, equal to the number of posts 42, of apertures 54 located substantially along the medial line and so dimensioned and disposed as to be opposite and slightly larger than corresponding tapped holes 43 when back 50 is resting on the posts and reinforcing piece 46 and spine 24 are conterminous. Reentrant lips 52 are so dimensioned as to provide access to apertures 54 for the insertion of screws 57 as will be described shortly. Back 50 is also provided with an ear 54 directly away from lips 52 and located substantially in line with apertures 54 and so disposed as to be displaced from the aperture corresponding to the post 42 nearest lip 29A toward the nearest end of reinforcing piece 46. Reinforcing piece 46 is preferably fabricated from sheet metal, although it will be understood that other materials may be used provided they possess the requisite strength and rigidity. Reinforcing piece 46 is secured to spine 24 by screws 57 inserted through apertures 54 and corresponding tapped holes 43, as may be seen by reference to FIG. 2.

Figure 4:
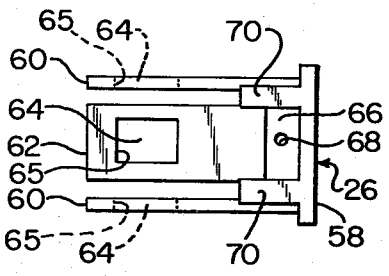
FIG. 4 is a plan view similar to that of FIG. 3 of an end piece of the document holder of FIG. 1.

Turning now to FIGS. 4 and 5, there may be seen an end piece 26. Both head and tail end pieces, 26A and 26B respectively, are similar in constructional details, differing only in the manner of their attachment to spine 24 and in the method of their operation, as will be described hereinafter. Consequently, the constructional details of only one end piece will be described, it being understood the other end piece possesses like parts. End piece 26 is provided with an end wall 58 to which the rest of the structure of the end piece is affixed. End wall 58 is in the form of a thin rectangular sheet, having a thickness on the order of that of a side 28 or back 30 of spine 24, and so dimensioned as to cover and close an open end of the channel formed by the sides and back of the spine, the width of end wall 58 being substantially the same as that of spine 24 and the height of the end wall being chosen to be substantially greater than that of a side 28 by an amount which depends upon the bound item to be secured by document holder 20, as will be described. Affixed to end wall 58, and extending in the same direction from and normal to the plane of the end wall are a pair of side tongues 60, back tongue 62, shelf 66, and a pair of fingers 70. Side tongues 60 and back tongue 62 are in the form of thin, substantially rectangular sheets, the thicknesses of which are preferably on the order of that of end wall 58. The tongues are so arranged that the long dimensions of their respective rectangular forms extend away from the end wall; it is this dimension which establishes the clearance mentioned hereinbefore by which posts 42 must be displaced from lips 29A and 29B. As will be appreciated by those skilled in the art, for reasons of stability this dimension should be at least approximately equal to the height of end wall 58. The remaining dimension of each side tongue 60 is chosen to be slightly less than the length of a post 42 of spine 24. The corresponding dimension of back tongue 62 is established to be somewhat less than the distance separating sides 28 of spine 24 less twice the sum of the thickness of a side tongue 60 and the maximum thickness of an inclined face 44. Side tongues 60 and back tongue 62 are disposed on end wall 58 in the maner the sides and bottom of an inverted drawer are disposed on its front: side tongues 60 being parallel to one another and to the edges of the end wall delimiting its width, while back tongue 62 is normal to and disposed midway between the side tongues. Each tongue 60 and 62 is displaced from the nearest edge of end wall 58 to which it is parallel by a distance substantially equal to the thickness of a side 28 or of back 30. The edges of side tongues 60 nearest the edge of end wall 58 from which back tongue 62 is so set back are similarly displaced, so as to be coplanar with the surface of back tongue 62 nearest the edge of the end wall.

Each tongue 60 and 62 is provided with a substantially rectangular latch aperture 64. Each latch aperture 64 is provided with a latch face 65 defining the edge of the aperture distal from end wall 58. Latch faces 65 are substantially coplanar and parallel to end wall 58 and dimensioned therefrom the same distance as latch faces 45 of spine 24 are from tail lips 29B. Latch apertures 64 are disposed and dimensioned as to accommodate corresponding inclined faces 44 and place corresponding latch faces 45 and 65 in tight opposing contact when an end piece 26 is inserted, drawer-like, in the opening between spine 24 and reinforcing piece 46 to the point where end wall 58 contacts tail lips 29B, thereby securing tail end piece 26B to the spine, as will be described in detail hereinafter.

Shelf 66 is disposed clear of tongues 60 and 62 midway between side tongues 60, parallel to back tongue 62, and within the confines of the drawer formed by the tongues. Shelf 66 is provided with aperture 68 penetrating therethrough. Aperture 68 has a small cylindrical bore, situated adjacent end wall 58 and having an axis substantially normal to the plane of back tongue 62. Shelf 66 serves merely to provide structure for aperture 68, and accordingly need extend about the aperture only by dimensions on the order of the size of the aperture; the thickness of the shelf is of the same order of magnitude as that of tongues 60 and 62.

Fingers 60 are disposed adjacent the edge of end wall 58 distal from back tongue 62, and slightly inboard of the planes of side tongues 60. Fingers 60 are elongate posts of rectangular cross section, the long dimension of the cross section being parallel to the planes of side tongues 60. End wall 58 is dimensioned to have a height which exceeds this dimension of fingers 70 plus the height of a side 28 less the amount of set back of reentrant lips 52 at the same location transverse the longitudinal axis of holder 20 by an amount equal to the thickness of the spine of the bound item to be accommodated. The length of a finger 70 (i.e., the extent normal to end wall 58) is chosen to be a moderate fraction (i.e., on the order of $\frac{1}{4}$ to $\frac{1}{3}$) of the similar dimension of a torque 60.

Spring 72, which is secured to ear 56 on reinforcing piece 46 at one end and to aperture 68 in shelf 66 at the other, secures head end piece 26A to spine 24, as may be seen by reference to FIGS. 2 and 5. Spring 72 is so dimensioned as to hold end wall 58 of head end piece 26A against head lip 28A under tension yet allow the drawer-like extension of the end piece by a distance on the order of the length of a tongue 60 without exceeding the elastic limit of the spring.

Assembly of document holder 20 may most readily be accomplished by first assembling an end piece 26, destined to become head end piece 26A, to reinforcing piece 46. An end of spring 72 is connected to end piece 26A via aperture 68, and the end piece is placed on back 50 of reinforcing piece 46 with side tongues 60 resting on the back opposite and parallel to sides 48, and with spring 72 extending between the tongues substantially along the medial line of the back. The other end of spring 72 is attached to ear 56, and end wall 58 of head end piece 26A is allowed to come to rest against the end of reinforcing piece 46. This assembly is now placed into the channel formed by sides 28 of spine 24, with back tongue 62 toward back 30 and side tongues 60 and sides 48 parallel to and between sides 28, and with end wall 58 of the end piece opposite lips 29A. Apertures 54 of reinforcing piece 46 are aligned with tapped holes 43 of posts 42, and the reinforcing piece is secured to spine 24 with screws 57. A second end piece 26, destined to become tail end piece 26B, is inserted drawer-like, with back tongue 62 in contact with the interior surface of back 30 and side tongues 60 in contact with the interior surfaces of sides 28, into the opening between spine 24 and reinforcing piece 46 and bounded by tail lips 29B.

As the end piece is forced inward, bringing end wall 58 toward lips 29B, tongues 60 and 62 encounter inclined faces 44. Further inward motion of end piece 26B results in the resilient distortion of tongues 60 and 62 away from contact with their respective opposing sides 28 and back 30, the tongues riding over inclined faces 44. As latch faces 65 override latch faces 45, latch apertures 64 come opposite their respective inclined faces 44, and the tongues spring back into parallel contact with their respective opposite sides and back, loading tail end piece 26B in place, just as end wall 58 comes into contact with tail lips 29B.

Figure 6:
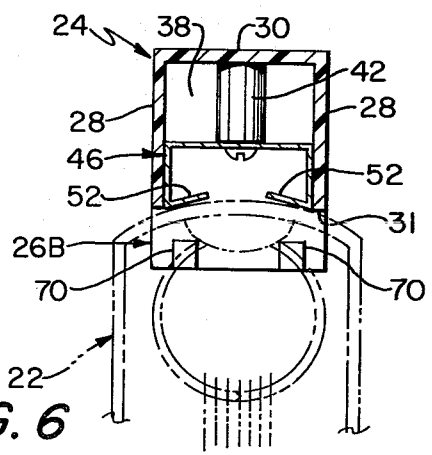
FIG. 6 is a cross-sectional view of the document holder of FIG. 1 taken along the line 6—6 of FIG. 2.

To apply document holder 20 to a bound article, such as as binder 22, the document holder is brought toward the binder with reentrant lips 52 facing and parallel to the spine of the binder and head and tail end pieces 26A and 26B aligned with the head and tail of the binder, respectively. Fingers 70 of tail end piece 26B are inserted into the binder so that the tail end of the spine of the binder rests on end wall 58 of the end piece between fingers 70 and lips 31 and reentrant lips 52, as shown in FIG. 6. Head end piece 26A is now manually pulled outward, away from tail end piece 26B, against the elastic restoring forces of spring 72 until its end wall 58 is clear of the head end of the spine of the binder by a distance exceeding the length of fingers 70. This permits the fingers of the head end piece to be inserted into the head end of the spine of the binder in the same way as the fingers of the tail end piece are inserted into the tail end of the spine. Head end piece 26A is now released, and spring 72 contracts bringing end wall 58 of the head end piece into contact with the head end of the spine of the binder. The spine of binder 22 is now captively engaged between fingers 70 and lips 31 and 52 at both head and tail ends, as shown in dotted lines in FIG. 2. It will be appreciated that the restraint of head end piece 26A by spring 72 not only permits the easy attachment and detachment of document holder 20 to binder 22 but also permits the document holder to accommodate binders of slightly differing heights.

When the holder is in use, suspending a document in a suspension filing system, the channel formed by sides 28 and back 30 is normally in the inverted position, as shown in FIG. 1. Inclined wall section 34 and edges 40 provide a pair of angularly disposed surfaces which facilitate the engagement of hooked tab 36 with a supporting rod of a filing system, not shown. It will be appreciated that the eccentric location of hook 32 will result in an imbalance of holder 20, with tail end piece 26B tending to rise above head end piece 26A. This deliberate imbalance particularly suits the holder of the present invention for use with filing systems of the type described in U.S. Pat. No. 3,980,360, wherein a flange, not shown, by contact on tail portion of back, indexed 30B in the drawings, both maintains the back horizontal in the stored position it provides, with the center of gravity of the holder, a couple which tends to better secure hook 32 on the supporting member of the filing system.

It will be apparent that the invention is susceptible of being practiced otherwise than as herein illustrated. For example, hook 32 need not be eccentrically mounted, nor the back be provided with a single hook. Further, tail end piece 26B may be affixed to spine 24 by means other than the latch means herein described; it may, for instance, be formed as a unitary member with the spine, or both end pieces may be made movable. Additionally, the defeatable restraint of head piece 26A relative to the tail piece 26B may be allowed for by means other than a spring, as, for instance, by an adjustable screw. Also the arrangement of fingers 70 on end pieces 26 may be varied, each end piece being provided with, for instance, a single central finger.

What is claimed is:

1. A device for filing bound items such as books, loose leaf notebooks, and the like, said bound items being characterized by having a binding with a spine terminating in head and tail edge portions, said device comprising in combination:

an elongate member having a longitudinal axis and longitudinally terminating in a first open end and a second open end spaced apart a distance substantially equal to that separating said edge portions, said member also having a back extending between said ends and a structure parallel to and remote from said back which is dimensioned to fit said spine;

a first end piece and a second end piece extending respectively into said first and second open ends, at least said first end piece being capable of limited longitudinal motion within said elongate member so as to be movable relative to said second end piece between a first position and a second position;

first and second elongate fingers attached to said first and second end pieces respectively, and disposed so that they extend toward said second and first ends respectively, said fingers being adjacent to said structure, and extending substantially parallel to said longitudinal axis, said fingers being more remote from said back than is said structure so as to accommodate between said first finger and said structure and between said second finger and said structure the said head and tail edge portions respectively of said binding; said first position being characterized by said first and second fingers being disposed nearer to one another than said head and tail edge portions are from one another and said second position being characterized by said first finger and second finger being disposed further from another than said head and tail edge portions are from one another;

defeatable restraining means for maintaining said first and second end pieces in said first position; and at least one hook means situated on said back of said member remote from said first and second ends;

whereby one of said bound items may be detachably affixed to said elongate member by the cooperative action of said first and second finger and said elongate member may be attached to a filing system by said hook means.

2. A device according to claim 1 wherein further said defeatable means is a spring.

3. A device according to claim 2 wherein said first end piece is movable and said second end piece is permanently affixed to said elongate member.

4. A device according to claim 3 wherein said hook means is disposed on said back nearer to said second end.

5. A device according to claim 1 wherein said elongate member is in the form of a hollow channel.

6. A device according to claim 5 wherein only said first end piece is movable relative to said channel, said second end piece being affixed to said channel by a snap connection.

7. A device according to claim 5 and further including a reinforcing member disposed in said channel parallel to and spaced apart from said back.

8. A device according to claim 7 wherein said channel and said reinforcing member form a guide restricting the motion of said end pieces.

9. A device according to claim 8 wherein further said reinforcing member constitutes said structure dimensioned to fit said spine.

10. A device according to claim 9 wherein further said structure is curved to fit a convex spine.

11. In combination:

a bound item such as a book, a loose leaf notebook, and the like, said bound items being characterized by having a binding with a spine terminating in head and tail edge portions;

a device for filing said bound items, said device comprising in combination:

an elongate member having a longitudinal axis and longitudinally terminating in a first open end and a second open end spaced apart a distance substantially equal to that separating said edge portions, said member having a back extending between said ends and a structure parallel to and remote from said back which is dimensioned to fit said spine;

a first end piece and a second end piece extending respectively into said first and second open ends, at least said first end piece being capable of limited longitudinal motion within said elongate member so as to be movable relative to said second end piece between a first position and a second position;

first and second elongate fingers attached to said first and second end pieces respectively and disposed so that they extend toward said second and first ends respectively, said fingers being adjacent to said structure and extending substantially parallel to said longitudinal axis, said fingers being more remote from said back than is said structure so as to accommodate between said first finger and said structure and between said second finger and said structure the said head and tail edge portions respectively of said binding; said first position being characterized by said first and second fingers being disposed nearer to one another than said head and tail edge portions are from one another and said second position being characterized by said first finger and said second finger being disposed further from one another than said head and tail edge portions are from one another;

defeatable restraining means for maintaining said first and second end pieces in said first position; and at least one hook means situated on said back of said member remote from said first and second ends;

whereby one of said bound items may be detachably affixed to said elongate member by the cooperative action of said first and second finger and said elongate member may be attached to a filing system by said hook means.

* * * * *